US010267605B1

(12) United States Patent
Meadows

(10) Patent No.: US 10,267,605 B1
(45) Date of Patent: Apr. 23, 2019

(54) HIGH G-FORCE RESISTANT INITIATOR ASSEMBLY HAVING AN EXPLODING FOIL INITIATOR

(71) Applicant: Reynolds Systems, Inc., Middletown, CA (US)

(72) Inventor: Michael B. Meadows, Kelseyville, CA (US)

(73) Assignee: Reynolds Systems, Inc., Middletown, CA (US)

( * ) Notice: Subject to any disclaimer, the term of this patent is extended or adjusted under 35 U.S.C. 154(b) by 577 days.

(21) Appl. No.: 14/501,656

(22) Filed: Sep. 30, 2014

(51) Int. Cl.
*F42B 3/12* (2006.01)
*F42D 1/045* (2006.01)
*F42B 3/198* (2006.01)

(52) U.S. Cl.
CPC ..... *F42B 3/125* (2013.01); *F42B 3/12* (2013.01); *F42B 3/198* (2013.01); *F42D 1/045* (2013.01)

(58) Field of Classification Search
CPC .... F42B 3/10; F42B 3/12; F42B 3/103; F42B 3/107; F42B 3/11; F42B 3/124; F42B 3/125; F42B 3/08; F42B 3/0807; F42B 3/0811; F42B 3/0815
USPC ..... 102/202.7
See application file for complete search history.

(56) References Cited

U.S. PATENT DOCUMENTS 4,541,342 A * 9/1985 Routledge ..... 102/308
4,602,565 A * 7/1986 MacDonald et al. ..... 102/202.7
5,347,929 A * 9/1994 Lerche ..... E21B 43/1185 102/202.14
5,678,856 A * 10/1997 Headley ..... 280/737
5,789,697 A * 8/1998 Engelke et al. ..... 102/202.5
6,196,584 B1 * 3/2001 Shirk et al. ..... 280/737
6,851,370 B2 2/2005 Reynolds et al.
6,923,122 B2 8/2005 Hennings et al.
7,571,679 B2 8/2009 Nance
7,690,303 B2 * 4/2010 Reynolds ..... F42B 3/121 102/202.14
8,485,097 B1 7/2013 Nance et al.
8,726,808 B1 * 5/2014 Nance ..... F42B 3/10 102/202.14
2003/0019384 A1 * 1/2003 Voreck et al. ..... 102/439
2003/0184068 A1 * 10/2003 Nakashima et al. ..... 280/741
2009/0151584 A1 * 6/2009 Desai ..... F42B 3/121 102/202.7
2013/0133542 A1 * 5/2013 Morris ..... F42B 3/12 102/202.7

* cited by examiner

*Primary Examiner* — Derrick R Morgan

(74) *Attorney, Agent, or Firm* — Harness, Dickey & Pierce, P.L.C.

(57) ABSTRACT

An initiator assembly with a housing, an exploding foil initiator, an input charge, which is formed of an energetic material, and a support plate. The exploding foil initiator has a base coupled to the housing, a bridge mounted to the base, a flyer overlying the bridge, and a barrel. The barrel is coupled to the base and defines a channel through which the flyer traverses when the exploding foil initiator is activated. The support plate supports an axial end of the input charge and is interposed in a path of travel of the flyer between the bridge and the input charge. A related method is also provided.

25 Claims, 2 Drawing Sheets

HIGH G-FORCE RESISTANT INITIATOR ASSEMBLY HAVING AN EXPLODING FOIL INITIATOR

FIELD

The present disclosure relates to a high G-force resistant initiator assembly that has an exploding foil initiator and to a related method for manufacturing an initiator assembly.

BACKGROUND

This section provides background information related to the present disclosure which is not necessarily prior art.

Modern initiator assemblies are increasingly employing exploding foil initiators due in part to considerations for improved safety relative to initiator assemblies that employ other types of initiators (e.g., exploding bridge wires). In our testing, we have found that initiator assemblies that utilize an exploding foil initiator can be made relatively robust so as to be capable of surviving high G-force impacts. Nevertheless, exploding foil initiators remain susceptible to improvement.

SUMMARY

This section provides a general summary of the disclosure, and is not a comprehensive disclosure of its full scope or all of its features.

In one form, the present disclosure provides an initiator assembly that includes a housing, an exploding foil initiator, an input charge and a support plate. The exploding foil initiator is disposed in the housing and includes a base, a bridge mounted to the base, a flyer overlying the bridge, and a barrel. The barrel has a proximal side, which is coupled to the base, and a distal side that is opposite the proximal side. The barrel forms a channel through which the flyer traverses when the exploding foil initiator is activated. The input charge is received in the housing and is formed of an energetic material. The support plate has a pair of opposite sides that abut an axial end of the input charge and an axial end of the barrel, respectively.

In another form, the present disclosure provides an initiator assembly that includes a housing, an exploding foil initiator, an input charge and a support plate. The exploding foil initiator is disposed in the housing and includes a base, a bridge mounted to the base, a flyer overlying the bridge, and a barrel. The barrel is coupled to the base and defines a channel through which the flyer traverses when the exploding foil initiator is activated. The input charge is received in the housing and is formed of an energetic material. The support plate is interposed in a path of travel of the flyer between the bridge and the input charge.

In still another form, the present disclosure provides a method for manufacturing an initiator assembly that includes: providing an exploding foil initiator having a flyer; providing an input charge that is formed of an energetic material; and interposing a support plate in a path of travel of the flyer between the exploding foil initiator and the input charge such that the support plate is located in a path of travel of the flyer. The support plate abuts an axial end of the input charge and is configured to be impacted by the flyer when the initiator assembly is activated and to transmit force received from the flyer directly to the input charge.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
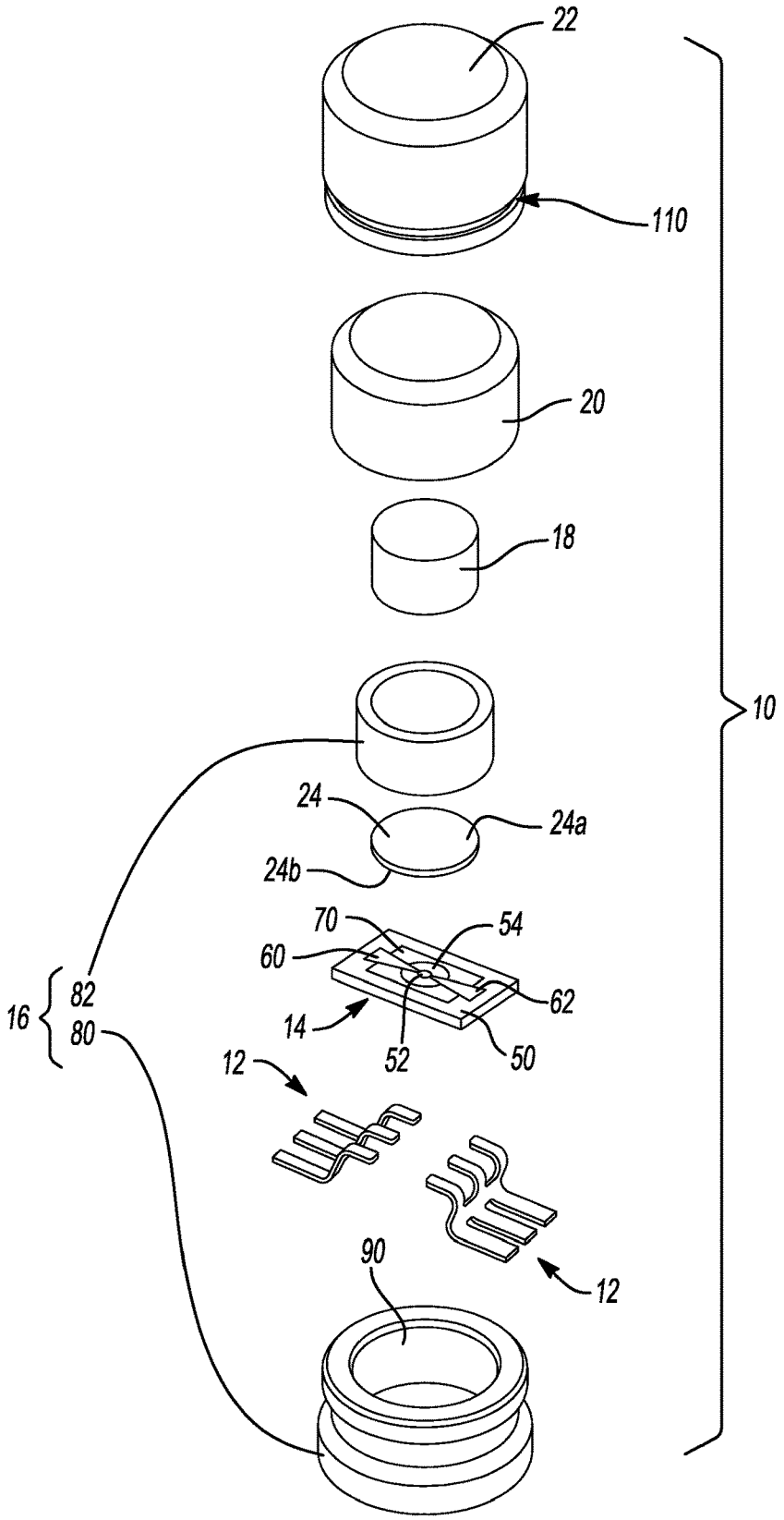
FIG. 1 is an exploded perspective view of an initiator assembly constructed in accordance with the teachings of the present disclosure.

With reference to FIG. 1 of the drawings, an exemplary initiator assembly constructed in accordance with the teachings of the present disclosure is generally indicated by reference numeral 10. Except as detailed below, the initiator assembly 10 in the particular example provided is similar to the initiator assembly described in U.S. Pat. No. 7,690,303, the disclosure of which is incorporated by reference as if fully set forth in detail herein. Those of skill in the art will appreciate, however, that the teachings of the present disclosure have application to other types of initiator assemblies that employ an exploding foil initiator to initiate an input charge that is formed of an energetic material, such as U.S. Pat. Nos. 8,726,808, 8,485,097, 7,571,679, 6,851,370 and 6,923,122, the disclosures of which are incorporated by reference as if fully set forth in detail herein.

The initiator assembly 10 can include a plurality of electrical contacts 12, an initiator 14, a housing 16, an input charge 18, an output charge 20, a cover 22 and a support plate 24. The electrical contacts 12 can be formed as a portion of a lead frame (not specifically shown) that may be configured to support the initiator 14 during the fabrication of the initiator assembly 10. The electrical contacts 12 can be formed from any appropriate electrically conductive material, such as an iron, nickel and cobalt alloy that is allowed per ASTM F15, or a copper material, such as beryllium copper or gold-plated beryllium copper.

Figure 2:
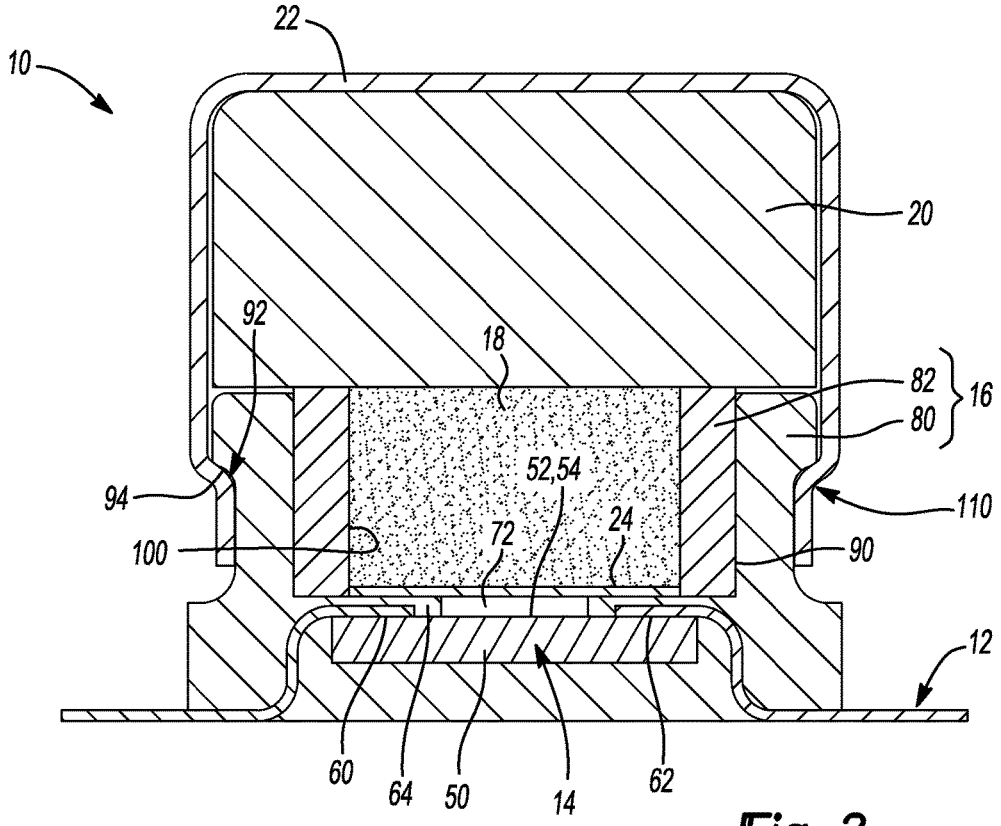
FIG. 2 is a longitudinal section view of the initiator assembly of FIG. 1.
Figure 3:
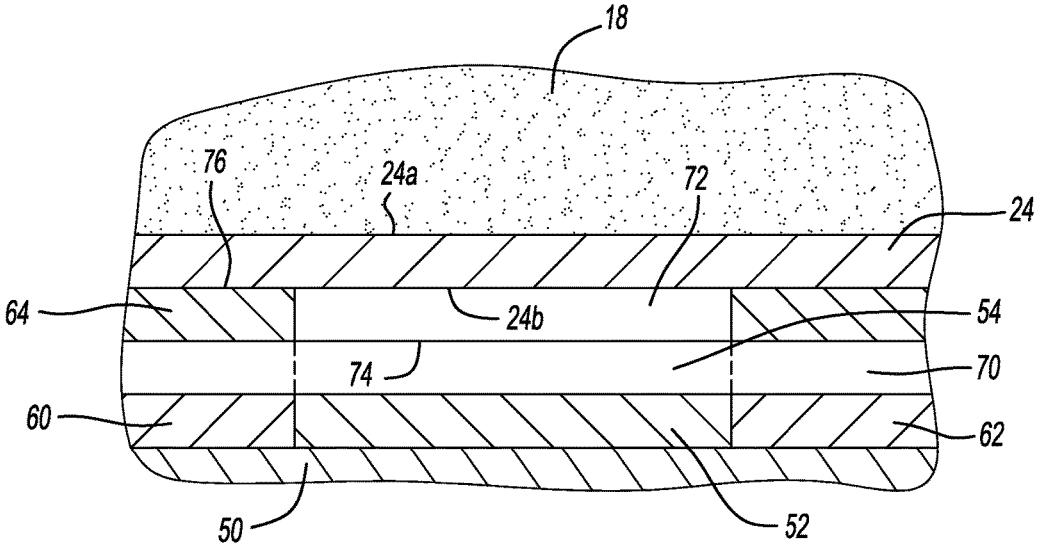
FIG. 3 is an enlarged portion of FIG. 2, illustrating a support plate in abutment with both an axial end of an input charge and a distal side of a barrel of an exploding foil initiator.

With reference to FIGS. 1 through 3, the initiator 14 can be an exploding foil initiator that can have a base 50, a bridge 52, a flyer 54, first and second bridge contacts 60 and 62, respectively, and a barrel 64. The base 50 can be formed of a structural, electrically insulating material, such as a ceramic material. The bridge 52 and the first and second bridge contacts 60 and 62, respectively, can be formed of a suitable electrically conductive material, such as copper, and can be mounted to the base 50. In the particular example provided, the bridge 52 and the first and second bridge contacts 60 and 62 are formed on the base 50 via metal vapor deposition. The first bridge contact 60 is configured to electrically couple a first one of the electrical contacts 12 to the bridge 52 and the second bridge contact 62 is configured to electrically couple a second one of the electrical contacts 12 to the bridge 52. It will be appreciated that the first and second bridge contacts 60 and 62 can be coupled to respective ones of the electrical contacts 12 via any suitable means, such as soldering and/or adhesives. A layer 70 of a suitable material, such as polyamide, can be disposed over an area that includes the bridge 52 to provide material that will form the flyer 54. The barrel 64 can be a structure that can be mounted to or over the layer 70 and can define a channel or barrel aperture 72 that is disposed axially in-line with the bridge 52 and the flyer 54. In the particular example provided, the barrel 64 is co-formed with a portion of the housing 16 as is disclosed in U.S. Pat. No. 7,690,303. Alternatively, the barrel 64 could be formed by a discrete structure that is separate and distinct from the housing 16. The barrel 64 can have a proximal side 74, which can be coupled to the base 50, and a distal side 76 that is opposite the proximal side 74.

The housing 16 can comprise an outer housing structure, such as a housing body 80, and an inner housing structure, such as a sleeve 82. The housing body 80 can be unitarily formed of any desired material, such as a plastic material that can comprise polycarbonate, acrylic or ABS. The material for the housing body 80 can be selected based on material characteristics, such as strength, density and/or coefficient of thermal expansion. In instances where the housing body 80 is formed of a plastic material, the housing body 80 can be formed to fully or partly encapsulate portions of the initiator 14 that are not defined by the housing body 80. Additionally, the housing body 80 can include a cavity 90 for at least partly housing the sleeve 82 (if one is included) and the input charge 18, as well as an attachment feature 92 that can facilitate the attachment of the cover 22 to close the cavity 90. In the example provided, the attachment feature 92 includes a flange 94 that is formed about the circumference of the housing body 80. As noted above, the barrel 64 in the particular example provided is co-formed with the housing body 80. The barrel 64 is disposed along a longitudinal axis of the initiator assembly 10 between the base 50 of the initiator 14 and the cavity 90.

The sleeve 82 can be employed to provide additional support to the input charge 18 and can be formed of a suitable material, such as 6061 T6 anodized aluminum. In the particular example provided, the sleeve 82 is formed as a short tubular segment that defines a sleeve chamber 100 into which the material that forms the input charge 18 is consolidated.

The input charge 18 can be received in the sleeve chamber 100 in the sleeve 82 and can be formed from any desired energetic material, such as a secondary explosive. Suitable secondary explosives include without limitation RSI-007, which may be obtained from Reynolds Systems, Inc. of Middletown, Calif.; HNS-IV (hexanitrostilbene), PETN (pentaerithrytol tetranitrate) or NONA (nonanitroterphenyl). The output charge 20 can be positioned to receive energy that is output from the input charge 18 when the initiator assembly 10 is activated. In the example provided, the output charge 20 is positioned in abutment with the sleeve 82 and the input charge 18, but those of skill in the art will appreciate that the output charge 20 could be optionally configured to be at least partially received into the sleeve chamber 100 and/or the cavity 90. The output charge 20 can be formed of a suitable energetic material that may be tailored to a specific situation in a manner that is within the capabilities of one of ordinary skill in the art. In the particular example provided, the output charge 20 is a suitable secondary explosive, such as HNS-IV. The input charge 18 and optionally the output charge 20 can be pressed into the sleeve 82 at pressures that may exceed 50,000 psi gauge or more.

The cover 22 can be coupled to the housing body 80 to close the cavity 90 and to secure the input charge 18 and the output charge 20 to the housing body 80. The cover 22 can be formed of any suitable material, such as aluminum, and can be coupled to the housing body 80 in any appropriate manner. In the particular example provided, the cover 22 is deformed in the area about the flange 94 on the housing body 80 to form a mating attachment feature 110 that inhibits the withdrawal of the cover 22 from the housing body 80. It will be appreciated, however, that any other means may be employed to secure the cover 22 to the housing body 80, such as threads, adhesives or welding (assuming that both the cover 22 and the housing body 80 are made of weld-compatible materials).

The support plate 24 is configured to support the input charge 18 on an axial side that is adjacent to the barrel 64. Accordingly, the support plate 24 can be formed of an appropriate structural material, such as a plastic, ceramic, composite and/or metallic material, and can have a thickness that is sufficient to provide the desired level of support. In the particular example provided, the support plate 24 is formed of titanium, but it will be appreciated that various other metals can be selected, including steel, aluminum and stainless steel. The thickness of the support plate 24 can be less than or equal to 0.01 inch and preferably less than or equal to 0.005 inch. In the particular example provided, the support plate 24 has a thickness of 0.001 inch. The support plate 24 can be fixedly coupled to the housing 16 in any desired manner. For example, the support plate 24 can be welded to or press-fit into the sleeve 82. The support plate 24 can have a first face 24*a*, which can be abutted against the axial end of the input charge 18, and a second face 24*b* that can abut the distal side 76 of the barrel 64. In the particular example provided, the support plate 24 is sized to overlie the axial end of the input charge 18 in its entirety.

To activate the initiator assembly 10, electrical power is transmitted via the electrical contacts 12 between the first and second bridge contacts 60 and 62 to vaporize the bridge 52 and form a plasma that causes the flyer 54 to shear from the layer 70 and accelerate the flyer 54 as it travels through the barrel aperture 72 in the barrel 64. In a conventionally configured initiator assembly having an exploding foil initiator, the flyer 54 would be configured to directly impact against the input charge 18 to initiate a detonation event to initiate a detonation event in the input charge 18. The initiator assembly 10 of the present disclosure includes the support plate 24, which is disposed in the path of travel of the flyer 54 between the exploding foil initiator 14 and the input charge 18 such that the flyer 54 directly contacts the support plate 24 on a side opposite the axial end of the input charge 18. Configuration of the initiator assembly 10 in this manner attenuates some of the energy that is transmitted from the flyer 54 to the input charge 18 but provides additional support to the input charge 18 so that the initiator assembly 10 may be activated despite exposure to a relatively high G-force impact.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

a housing;

an exploding foil initiator having a base that is coupled to the housing, a bridge mounted to the base, a flyer overlying the bridge, and a barrel, the barrel having a proximal side, which is coupled to the base, and a distal side that is opposite the proximal side, the barrel forming a channel through which the flyer traverses when the exploding foil initiator is activated;

an input charge in the housing and being formed of a secondary explosive;

a support plate having a pair of opposite sides that abut an axial end of the input charge and the distal side of the barrel, respectively;

the support plate being interposed in a path of travel of the flyer between the bridge and the input charge; and wherein the housing defines a chamber into which a material that forms the input charge is consolidated, the housing rigidly supporting the input charge over an area where the housing and the input charge directly abut, and wherein the support plate is received in the chamber.

2. The initiator assembly of claim 1, wherein the support plate has a thickness that is less than or equal to 0.010 inch.

3. The initiator assembly of claim 2, wherein the thickness of the support plate is less than or equal to 0.005 inch.

4. The initiator assembly of claim 1, wherein the support plate is formed of metal.

5. The initiator assembly of claim 4, wherein the metal is selected from a group consisting of titanium, steel, aluminum and stainless steel.

6. The initiator assembly of claim 1, wherein the support plate is fixedly coupled to the housing.

7. The initiator assembly of claim 6, wherein the support plate is press-fit to the housing.

8. The initiator assembly of claim 6, wherein the support plate is welded to the housing.

9. The initiator assembly of claim 6, wherein the housing comprises an outer housing structure and an inner housing structure, the outer housing structure defining a bore, the inner housing structure being received in the bore, the input charge being compacted within the inner housing structure.

10. The initiator assembly of claim 1, wherein the support plate overlies the axial end of the input charge in its entirety.

11. A method for forming an initiator assembly comprising:

providing an exploding foil initiator having a flyer;

coupling the exploding foil initiator to a housing, the housing defining a chamber;

inserting an input charge into the chamber such that the housing abuts a radial perimeter of the input charge, the input charge being formed of a secondary explosive; and interposing a support plate in a path of travel of the flyer between the exploding foil initiator and the input charge such that the support plate is located in the path of travel of the flyer, wherein the support plate abuts an axial end of the input charge operating the exploding foil initiator to propel the flyer along the path of travel and impact the support plate to create a shock wave;

transmitting the shock wave through the support plate and into the input charge, the shock wave initiating detonation of the input charge.

12. The method of claim 11, wherein the support plate has a thickness that is less than or equal to 0.010 inch.

13. The method of claim 12, wherein the thickness of the support plate is less than or equal to 0.005 inch.

14. The method of claim 11, wherein the support plate is formed of metal.

15. The method of claim 14, wherein the metal is selected from a group consisting of titanium, steel, aluminum and stainless steel.

16. An initiator assembly comprising:

a housing defining a chamber;

an exploding foil initiator having a base that is coupled to the housing, a bridge mounted to the base, a flyer overlying the bridge, and a barrel, the barrel is coupled to the base and defines a channel through which the flyer traverses when the exploding foil initiator is activated;

an input charge in the chamber and having an exterior perimeter surface that abuts the housing so that the housing rigidly supports the input charge, the input charge being formed of a secondary explosive; and a support plate that supports an axial end of the input charge, the support plate being interposed in a path of travel of the flyer between the bridge and the input charge.

17. The initiator assembly of claim 16, wherein the support plate has a thickness that is less than or equal to 0.010 inch.

18. The initiator assembly of claim 17, wherein the thickness of the support plate is less than or equal to 0.005 inch.

19. The initiator assembly of claim 16, wherein the support plate is formed of metal.

20. The initiator assembly of claim 19, wherein the metal is selected from a group consisting of titanium, steel, aluminum and stainless steel.

21. The initiator assembly of claim 16, wherein the support plate is fixedly coupled to the housing.

22. The initiator assembly of claim 21, wherein the support plate is press-fit to the housing.

23. The initiator assembly of claim 21, wherein the support plate is welded to the housing.

24. The initiator assembly of claim 21, wherein the housing comprises an outer housing structure and an inner housing structure, the outer housing structure defining a bore, the inner housing structure being received in the bore, the input charge being compacted within the inner housing structure.

25. The initiator assembly of claim 16, wherein the support plate overlies the axial end of the input charge in its entirety.

* * * * *